US009682468B2

(12) United States Patent
Blum et al.

(10) Patent No.: US 9,682,468 B2
(45) Date of Patent: Jun. 20, 2017

(54) HEAT-DISSIPATION COMPONENT FOR HANDHELD MACHINE TOOL

(75) Inventors: Jens Blum, Filderstadt (DE); Heiko Roehm, Stuttgart (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 671 days.

(21) Appl. No.: 13/825,183

(22) PCT Filed: Sep. 7, 2011

(86) PCT No.: PCT/EP2011/065455
§ 371 (c)(1),
(2), (4) Date: Jun. 5, 2013

(87) PCT Pub. No.: WO2012/038254
PCT Pub. Date: Mar. 29, 2012

(65) Prior Publication Data

US 2013/0248217 A1 Sep. 26, 2013

(30) Foreign Application Priority Data

Sep. 20, 2010 (DE) ..... 10 2010 041 045

(51) Int. Cl.
*B25D 11/10* (2006.01)
*B25D 17/20* (2006.01)

(52) U.S. Cl.
CPC ..... *B25D 11/10* (2013.01); *B25D 11/106* (2013.01); *B25D 17/20* (2013.01); *B25D 2217/0061* (2013.01); *B25D 2250/121* (2013.01)

(58) Field of Classification Search
CPC ..... B25D 11/10; B25D 11/106; B25D 17/20; B25D 2217/0061; B25D 2250/121
See application file for complete search history.

(56) References Cited

U.S. PATENT DOCUMENTS

| | | | | |
|---|---|---|---|---|
| 3,955,628 | A * | 5/1976 | Grozinger | B25D 16/003 173/13 |
| 4,479,555 | A * | 10/1984 | Grossmann | B25D 11/106 173/171 |
| 5,449,043 | A | 9/1995 | Bourner et al. | |
| 2010/0026107 | A1 | 2/2010 | Hosokawa | |

FOREIGN PATENT DOCUMENTS

| | | |
|---|---|---|
| CN | 101036983 | 9/2007 |
| CN | 101637826 | 2/2010 |
| DE | 10 2008 064 511 | 6/2010 |
| EP | 0 399 714 | 11/1990 |
| GB | 1315903 | 5/1973 |

OTHER PUBLICATIONS

International Search Report, PCT International Application No. PCT/EP2011/065455, dated Dec. 21, 2011.

* cited by examiner

*Primary Examiner* — Thanh Truong
*Assistant Examiner* — Thomas Wittenschlaeger
(74) *Attorney, Agent, or Firm* — Norton Rose Fulbright US LLP; Gerard Messina

(57) ABSTRACT

A handheld machine tool has a drive motor for driving a tool holder, in which a tool is able to be accommodated. In addition, a cam-action mechanism for generating a hammer function is provided, which includes a cam-action mechanism holder and a notched disk. The cam-action mechanism holder is in contact with a heat-dissipating component situated inside the housing.

14 Claims, 2 Drawing Sheets

HEAT-DISSIPATION COMPONENT FOR HANDHELD MACHINE TOOL

FIELD

The present invention relates to a handheld machine tool such as a hammer drill.

BACKGROUND INFORMATION

Handheld electric tools such as a battery-operated hammer drill provided with an electric motor as drive device, which drives a connectable cam-action mechanism in order to produce the hammer function, are conventional. On the housing side, the cam-action mechanism includes a cam-action mechanism holder provided with a circumferential, sinusoidal wave profile at the end face; to produce the hammer function, this profile cooperates with a circumferential notched disk, which is permanently joined to the drive spindle of the handheld machine tool. The drive spindle is the carrier of a tool holder and driven by the motor shaft of the electric drive motor.

When the cam-action mechanism is in operation, the friction contact between the cam-action mechanism holder and the notched disk produces heat, which must be dissipated via surrounding housing components. If the housing is made of plastic, excessive heat buildup is to be avoided.

SUMMARY

In accordance with an example embodiment of the present invention, simple constructive measures are used to develop a handheld machine tool, which is provided with a cam-action mechanism and able to be operated in a reliable manner.

The handheld machine tool according to the present invention, preferably a hammer drill, has a drive motor, in particular an electric drive motor, which drives a tool holder into which a tool is able to be inserted. The handheld machine tool includes a cam-action mechanism, which is equipped with a housing-side cam-action mechanism holder and a notched disk connected to a drive spindle or to the tool holder, the tool holder sitting on the drive spindle. The drive spindle is driven by the motor shaft of the drive motor, and a gearing, e.g., a planetary gearing, may be situated between the motor shaft and drive spindle for transmitting the motion.

To ensure adequate and reliable dissipation of the frictional heat produced while the cam-action mechanism is in operation, i.e., while frictional contact exists between the cam-action mechanism holder and the notched disk, the cam-action mechanism holder, which is housing-mounted in the direction of rotation, is in contact with a heat-dissipating component, which is located inside the housing or inside a gear housing. The heat-dissipating component is a self-contained component, which is fixedly joined to the housing, but not part of the housing. As a result, the heat-dissipating component is able to be optimized with regard to its heat-dissipating function. The heat-dissipating component in particular has a large surface and is made of a material having high thermal conductivity. Via the contact between the heat-dissipating component and the cam-action mechanism holder, heat is initially transferred to the heat-dissipating component as a result of the thermal conductivity, where the heat spreads according to the same principle. The dissipation of the heat from the heat-dissipating component to the environment largely takes place by heat radiation or convection.

According to one advantageous development, the heat-dissipating component axially supports the cam-action mechanism holder inside the housing; in so doing, it may be useful if the heat-dissipating component simultaneously exerts an axial force on the cam-action mechanism holder. This ensures close contact between the heat-dissipating component and the cam-action mechanism holder, thereby providing excellent heat transfer. In addition, the tool holder of the cam-action mechanism is axially fixed in place inside the housing by pressure via the heat-dissipating component.

The heat-dissipating component advantageously extends up to the tool holder, especially to a gap between the end face of the housing and the tool holder, so that the air flow generated when the drill chuck is rotating contributes to cooling of the heat-dissipating component.

The heat-dissipating component is fixed in place inside the housing of the handheld machine tool with the aid of affixation elements, such as screws. At the same time, the affixation elements may also hold different parts of the housing or other components of the handheld machine tool in position relative to each other. Furthermore, it is possible that the heat-dissipating component forms an axial stop for a coupling adjustment ring of the handheld machine tool. It may furthermore be the case that the heat-dissipating component also forms a sealing gap with respect to the abutting component(s) at the inner diameter and/or at the outer diameter.

According to another useful development, the cam-action mechanism holder is situated adjacent to the end face of the housing facing the tool holder, and the spindle bearings used as support for the drive spindle are axially positioned inside the housing on the side facing away from the cam-action mechanism holder. This makes it possible to place the cam-action mechanism holder in close proximity to the end face; the heat-dissipating component thus is likewise situated next to the end face, which has an advantageous effect on the heat dissipation to the environment.

According to another advantageous development, the heat-dissipating component is implemented in the form of a cup. A central recess, which surrounds the cam-action mechanism holder, is introduced in the cup bottom. The delimiting wall of the recess in the cup bottom advantageously acts on the cam-action mechanism holder, especially on holding flanges which are developed on the cam-action mechanism holder. The cup-shaped design furthermore has the advantage that a spring action for the axial fixation of the cam-action mechanism holder is achieved via the cup wall or the cup bottom. The heat dissipation in the direction of the end face of the housing, up to which the upper cup lip of the cup wall extends, takes place via the cylindrical cup wall.

The heat-dissipating component is made of a material having excellent thermal conductivity, in particular metal.

According to the present invention, a variety of advantages are derived from this development. A relatively low length of the drive train of the handheld machine tool is able to be obtained. The heat produced in cam-action operation is effectively dissipated to the outside via the heat-dissipating component, so that the gear parts of the handheld machine tool are exposed only to a low thermal stresses. The heat is dissipated to the environment in convective and/or radiative manner. Because of the effective heat dissipation, the plastic components next to the cam-action mechanism are exposed to lower thermal stressing and thus have a longer service life. Finally, the cam-action mechanism is able to be fixated inside the gear housing without play with the aid of the heat-dissipating component.

Further advantages and expedient implementations may be gathered from the description below and the figures.

DETAILED DESCRIPTION OF EXAMPLE EMBODIMENTS

Figure 1:
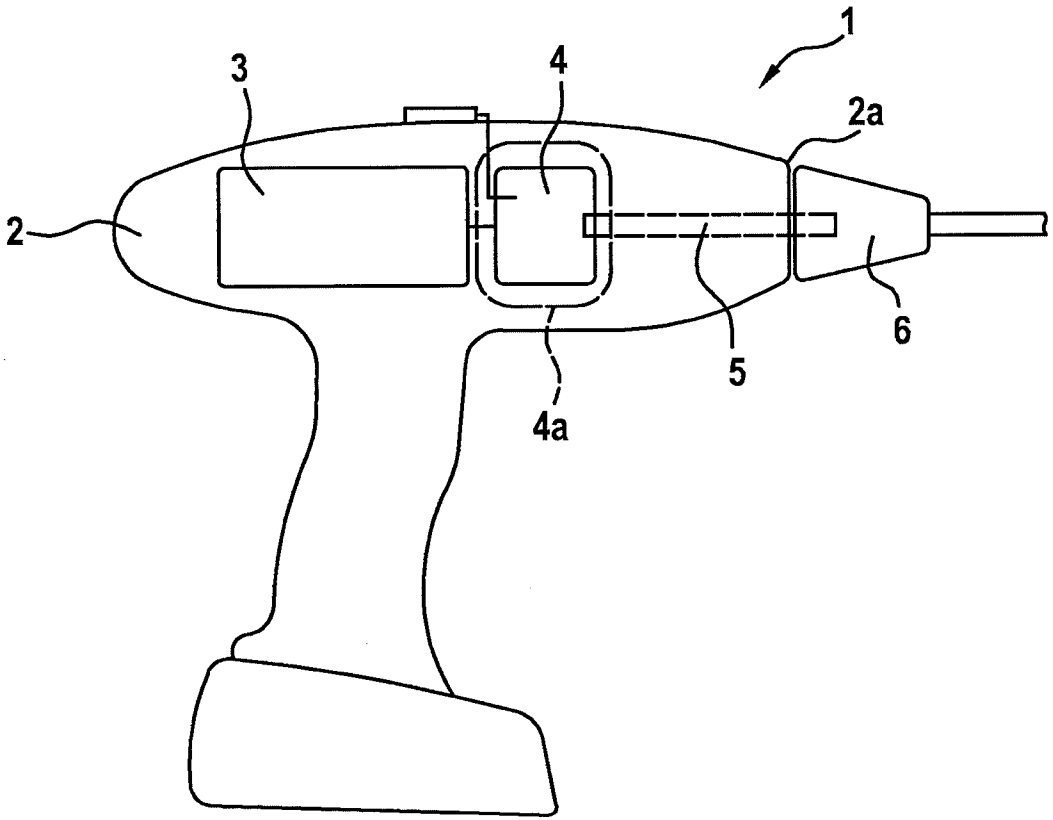
FIG. 1 shows a schematic representation of a handheld machine tool.

Identical elements are provided with the same reference numerals in the figures.

Handheld machine tool 1 shown in the figures is a battery-operated hammer drill and has a schematically represented electric drive motor 3 inside a housing 2; via a gear unit 4, preferably implemented as a planetary gearing and situated in a gear housing 4*a*, the drive motor drives a drive spindle 5 which supports a drill chuck 6 having a tool holder.

Figure 2:
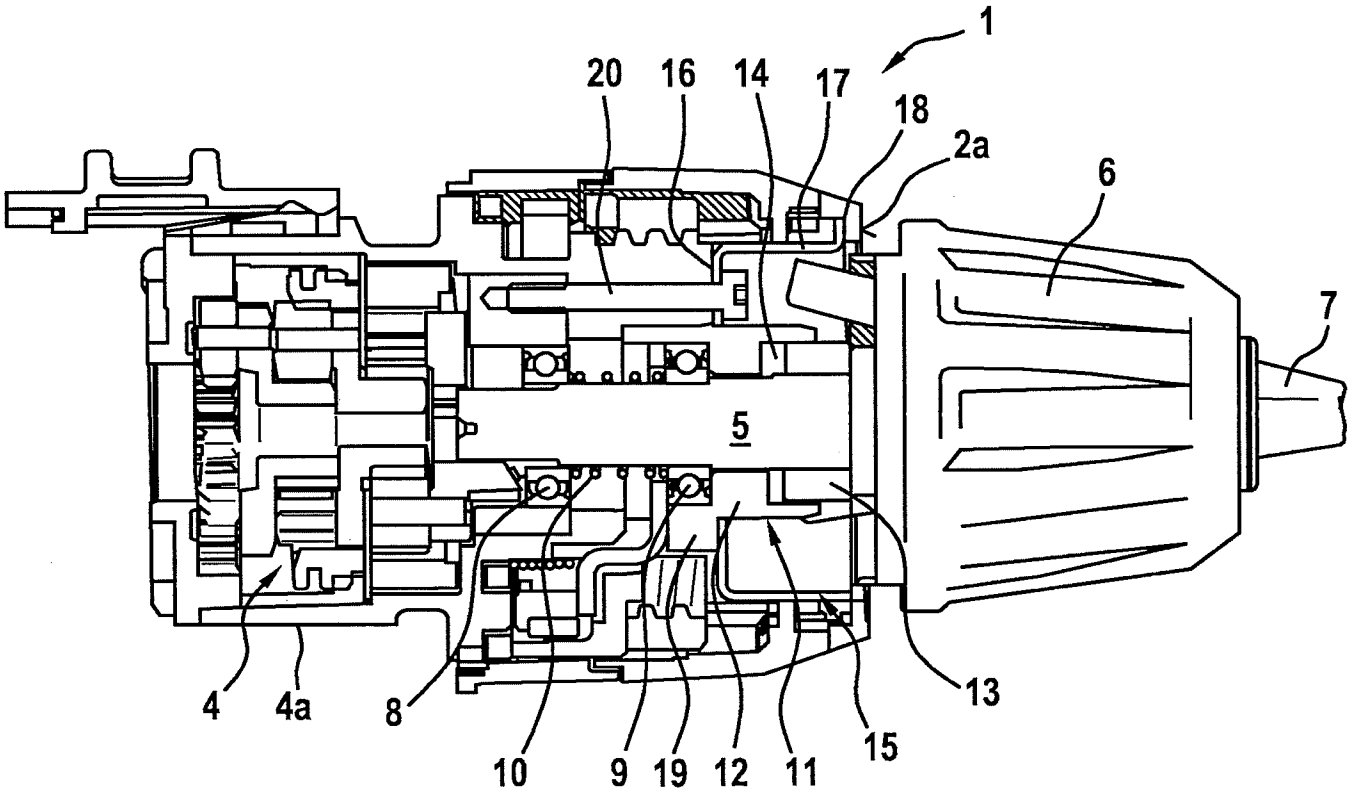
FIG. 2 shows the handheld machine tool in a section.

As can be gathered from FIG. 2, drive spindle 5 is supported in the housing in rotatable manner via two spindle bearings 8 and 9. First spindle bearing 8, which sits at a greater axial distance from end face 2*a*, is attached to the housing, and second spindle bearing 9 is developed as floating bearing and held so as to be displaceable in the axial direction. Second spindle bearing 9, which lies closer to end face 2*a*, is axially supported on first spindle bearing 8 via a spring element 10.

To realize a hammer function, handheld machine tool 1 is provided with a cam-action mechanism 11, which encompasses a cam-action mechanism holder 12 and a notched disk 13. Cam-action mechanism holder 12 is permanently joined to the gear housing. Drive spindle 5 is supported in a manner that allows it to be displaced relative to gear housing 4*a* in the axial direction. Annular notched disk 13 is fixedly connected to drive spindle 5; it is situated within gear housing 4*a* and is able to rotate inside gear housing 4*a*. On the end face facing the notched disk, cam-action mechanism holder 12 is provided with a sinusoidal or saw-tooth-like wave profile 14 rotating in the circumferential direction; this profile 14 comes into contact with a latching cam on notched disk 13 when cam-action mechanism holder 12 and notched disk 13 axially approach each other, so that rotating notched disk 13 probes the contour of wave profile 14 on cam-action mechanism holder 12 and thereby produces an axial relative motion that corresponds to the wave profile. The contact between cam-action mechanism holder 12 and notched disk 13 takes place when the tool in tool holder 7 is pressed against a workpiece to be processed, so that components 12 and 13 of cam-action mechanism 11 approach each other counter to the force of spring element 10.

A cup-shaped heat-dissipating component 15, which is mounted on the housing and is in contact with cam-action mechanism holder 12, is integrated into gear housing 4*a*. Frictional heat produced by the relative movement between notched disk 13 and cam-action mechanism holder 12 is shunted to the outside by way of heat-dissipating component 15.

Heat-dissipating component 15 has a cup bottom 16, into which a recess is introduced which wraps around cam-action mechanism holder 12. The wall delimiting the central recess in cup bottom 16 rests against the lateral surface of cam-action mechanism holder 12. In addition, the part of the wall that delimits the recess supports cam-action mechanism holder 12 in the cup bottom in that the wall is resting against a holding flange or against a plurality of holding flanges 19 distributed across the periphery, which are integrally formed with cam-action mechanism holder 12. In the process, heat-dissipating component 15 exerts an axial force on cam-action mechanism holder 12 and thereby fixes it in position inside the housing. Holding flanges 19 overlap second spindle bearing 9 in the axial direction, and the annular body of cam-action mechanism holder 12 carrying holding flanges 19 is situated between second spindle bearing 9 and end face 2*a*.

In the axial direction, cup wall 17 of heat-dissipating component 15 extends toward frontal end face 2*a*, which faces drill chuck 6, but lies at an axial distance from drill chuck 6. A radially outwardly projecting lip 18 on cup wall 17 is situated in direct proximity to end face 2*a*. When drill chuck 6 is rotating, an air flow is generated in the annular gap between the drill chuck and end face 2*a*, which helps in dissipating the heat to the environment.

Heat-dissipating component 15 is held inside housing 2 with the aid of affixation elements in the form of screws 20. Screws 20 are guided through cup bottom 16, parallel to the central recess, and anchor heat-dissipating component 15 at sections of the gear housing. Screws 20 are also able to interconnect different parts of the gear or the gear housing.

Cup-shaped heat-dissipating component 15 is made of a metal or some other material having high thermal conductivity.

What is claimed is:

1. A handheld machine tool, comprising:

a tool holder to accommodate a tool;

a drive motor to drive the tool holder; and a cam-action mechanism including a cam-action mechanism holder and a notched disk, wherein the cam-action mechanism holder is in contact with a heat-dissipating component situated inside a housing of the handheld machine tool, wherein the heat-dissipating component axially supports the cam-action mechanism holder and exerts an axial force thereon in an axial direction away from the tool holder towards the drive motor.

2. The hand-held machines tool as recited in claim 1, wherein the hand-held machine tool is a hammer drill.

3. The hand-held machine tool as recited in claim 1, wherein holding flanges are situated on a radial outside of the cam-action mechanism holder, on which the heat-dissipating component exerts an axial force.

4. The hand-held machine tool as recited in claim 1, wherein the heat-dissipating component is mounted on the housing in place relative to with the aid of affixation elements.

5. The hand-held machine tool as recited in claim 1, wherein the heat-dissipating component is configured in the form of a cup.

6. The hand-held machine tool as recited in claim 5, wherein the heat-dissipating component is fixed in place inside the housing of the handheld machine tool via a bottom of the cup.

7. The handheld machine tool as recited in claim 5, wherein the heat-dissipating component has a recess in a bottom of the cup in which the cam-action mechanism holder is accommodated.

8. The hand-held machine tool as recited in claim 5, wherein an open cup side of the heat-dissipating component faces the tool holder.

9. The hand-held machine tool as recited in claim 1, wherein the heat-dissipating component extends up to an end face of the housing adjacent to the tool holder.

10. The hand-held machine tool as recited in claim 1, wherein the heat-dissipating component is made of metal.

11. The hand-held machine tool as recited in claim 1, wherein the cam-action mechanism holder is situated adjacent to an end face of the housing facing the tool holder.

12. The hand-held machine tool as recited in claim 1, further comprising:

at least one spindle bearing configured to support a drive spindle, the at least one spindle bearing being axially disposed inside the housing on a side of the cam-action mechanism holder facing away from the tool holder.

13. A handheld machine tool, comprising:

a tool holder to accommodate a tool;

a drive motor to drive the tool holder; and a cam-action mechanism including a cam-action mechanism holder and a notched disk, wherein the cam-action mechanism holder is in contact with a heat-dissipating component situated inside a housing of the handheld machine tool, wherein the heat-dissipating component axially supports the cam-action mechanism holder and exerts an axial force thereon, wherein at least one holding flange is situated on a radial outside of the cam-action mechanism holder, on which the heat-dissipating component rests and exerts an axial force in an axial direction away from the tool holder towards the drive motor.

14. A handheld machine tool, comprising:

a tool holder to accommodate a tool;

a drive motor to drive the tool holder; and a cam-action mechanism including a cam-action mechanism holder and a notched disk, wherein the cam-action mechanism holder is in contact with a heat-dissipating component situated inside a housing of the handheld machine tool, wherein the heat-dissipating component axially supports the cam-action mechanism holder and exerts an axial force thereon, wherein the cam-action mechanism holder includes at least one holding flange on a radial outside of the cam-action mechanism holder and the heat-dissipating component rests on the at least one holding flange such that the cam-action mechanism holder is mounted in place relative to the housing by an axial force exerted by the heat-dissipating component on the at least one holding flange.

* * * * *